US011021893B2

(12) United States Patent
Trout et al.

(10) Patent No.: US 11,021,893 B2
(45) Date of Patent: Jun. 1, 2021

(54) SECURITY SYSTEM FOR A BUILDING

(71) Applicants: Roland Trout, Lexington, NC (US); Stephen Gardner Worth, III, Holly Springs, NC (US); William Neal Davis, Greensboro, NC (US); Eric Michael Wagner, Cary, NC (US); George Lee Reid, Greer, SC (US); Sanjeev Pal, Weddington, NC (US); John Allen Wiseman, Richmond, VA (US); Michael Clyde Pittman, Glen Allen, VA (US)

(72) Inventors: Roland Trout, Lexington, NC (US); Stephen Gardner Worth, III, Holly Springs, NC (US); William Neal Davis, Greensboro, NC (US); Eric Michael Wagner, Cary, NC (US); George Lee Reid, Greer, SC (US); Sanjeev Pal, Weddington, NC (US); John Allen Wiseman, Richmond, VA (US); Michael Clyde Pittman, Glen Allen, VA (US)

(73) Assignee: BARRICAID TECHNOLOGY GROUP, Lexington, NC (US)

( * ) Notice: Subject to any disclaimer, the term of this patent is extended or adjusted under 35 U.S.C. 154(b) by 0 days.

(21) Appl. No.: 16/580,694

(22) Filed: Sep. 24, 2019

(65) Prior Publication Data

US 2021/0087852 A1 Mar. 25, 2021

(51) Int. Cl.
*E05B 47/00* (2006.01)
*E05B 39/00* (2006.01)

(52) U.S. Cl.
CPC ..... *E05B 47/0001* (2013.01); *E05B 39/00* (2013.01); *E05B 2047/0069* (2013.01)

(58) Field of Classification Search
CPC ..... E05B 39/00; E05B 47/0001
USPC ..... 340/542
See application file for complete search history.

(56) References Cited

U.S. PATENT DOCUMENTS

| | | | | |
|---|---|---|---|---|
| 5,775,746 | A | 7/1998 | Charlton | |
| 8,325,039 | B2 | 12/2012 | Picard | |
| 9,286,790 | B2 | 3/2016 | Lyman | |
| 9,336,670 | B2 | 5/2016 | Jones, Jr. | |
| 9,353,550 | B1 * | 5/2016 | Smith, III | E05B 41/00 |
| 9,454,890 | B2 | 6/2016 | Lyman | |

(Continued)

FOREIGN PATENT DOCUMENTS

| | | |
|---|---|---|
| WO | PCT/US2015/045680 | 8/2015 |
| WO | WO2016/059359 A1 | 4/2016 |

*Primary Examiner* — Qutbuddin Ghulamali
(74) *Attorney, Agent, or Firm* — Steve LeBlanc, LLC

(57) ABSTRACT

A security system for a building has multiple lock modules. Each lock module is associated with a particular door and has an unlocked position that allows the particular door to open and a locked position that prevents the particular door from opening. Each lock module includes a door status signal and a controller. The door status signal includes a unique identifier for the particular door associated with the lock module and a status that identifies when the lock module is in the locked position. The controller transmits the door status signal for the lock module. A lock module command signal received by at least some of the lock modules directs at least some of the lock modules to reposition to either the unlocked position or the locked position.

20 Claims, 5 Drawing Sheets

(56) References Cited

U.S. PATENT DOCUMENTS

| | | | | |
|---|---|---|---|---|
| 9,589,449 | B2 * | 3/2017 | Lyman | G08B 19/005 |
| 9,691,245 | B2 | 6/2017 | Jones, Jr. | |
| 9,922,516 | B2 | 3/2018 | Jones, Jr. | |
| 2014/0269199 | A1 | 9/2014 | Weldon | |
| 2015/0204109 | A1 | 7/2015 | Ergenbright | |
| 2016/0047149 | A1 | 2/2016 | Bertelli | |
| 2017/0051544 | A1 * | 2/2017 | Bertelli | E05B 47/023 |
| 2018/0120899 | A1 | 5/2018 | Lyman | |
| 2018/0122030 | A1 | 5/2018 | Raz | |
| 2018/0204447 | A1 | 7/2018 | Morgan | |
| 2018/0313074 | A1 | 11/2018 | Brown | |
| 2018/0315283 | A1 | 11/2018 | Brosnan | |

* cited by examiner

SECURITY SYSTEM FOR A BUILDING

FIELD OF THE INVENTION

The present invention generally involves a security system for a building. Particular embodiments of the present invention may provide local and/or remote lockdown and/or monitoring capability for multiple doors in the building to control access inside the building.

BACKGROUND OF THE INVENTION

Schools, airports, dormitories, and virtually all commercial and private buildings often include multiple interior rooms. It is generally necessary to allow students, employees, guests, and other authorized personnel to enter the buildings and freely move between the interior rooms throughout the day. The number of authorized personnel in a building can be significant, and the authorized personnel may need to move between the interior rooms multiple times throughout the day. Therefore, providing convenient and relatively unrestricted access to enter the building and move between the interior rooms is often an important design consideration that must be balanced with security measures to limit and/or prevent unauthorized access to the building or between interior rooms in the building.

The relatively large number of occupants in a building creates an increased threat that an armed person may access the building for criminal purposes. Although the capability exists to secure the building and interior rooms from unauthorized access, prompt communication throughout the building of an active threat is often not possible. As a result, several instances have been reported in which an armed shooter, such as a disgruntled student, an employee, or even a complete stranger, gained access to a school or office building and indiscriminately attacked personnel in multiple rooms before being stopped.

Therefore, the need exists for an improved security system for a building that can provide local and/or remote lockdown and/or monitoring capability for multiple doors in the building to promptly control access inside the building.

BRIEF DESCRIPTION OF THE INVENTION

Aspects and advantages of the invention are set forth below in the following description, or may be obvious from the description, or may be learned through practice of the invention.

One embodiment of the present invention is a security system for a building that includes multiple lock modules. Each lock module is associated with a particular door and has an unlocked position that allows the particular door to open and a locked position that prevents the door from opening. A door status signal associated with each lock module includes a unique identifier and a door position signal for the particular door associated with the lock module. A controller associated with each lock module transmits the door status signal for the associated lock module. A lock module command signal is communicated to at least some of the controllers and directs at least some of the lock modules to reposition to either the unlocked position or the locked position. Each controller enables the associated lock module to reposition to the locked position when the door position signal reflects that the particular door associated with the associated lock module is shut.

An alternate embodiment of the present invention is a security system for a building that includes multiple lock modules. Each lock module is associated with a particular door and has an unlocked position that allows the particular door to open and a locked position that prevents the particular door from opening. Each lock module includes a door status signal and a controller. The door status signal includes a unique identifier for the particular door associated with the lock module and a status that identifies when the lock module is in the locked position. The controller transmits the door status signal for the lock module. A lock module command signal received by at least some of the lock modules directs at least some of the lock modules to reposition to either the unlocked position or the locked position.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
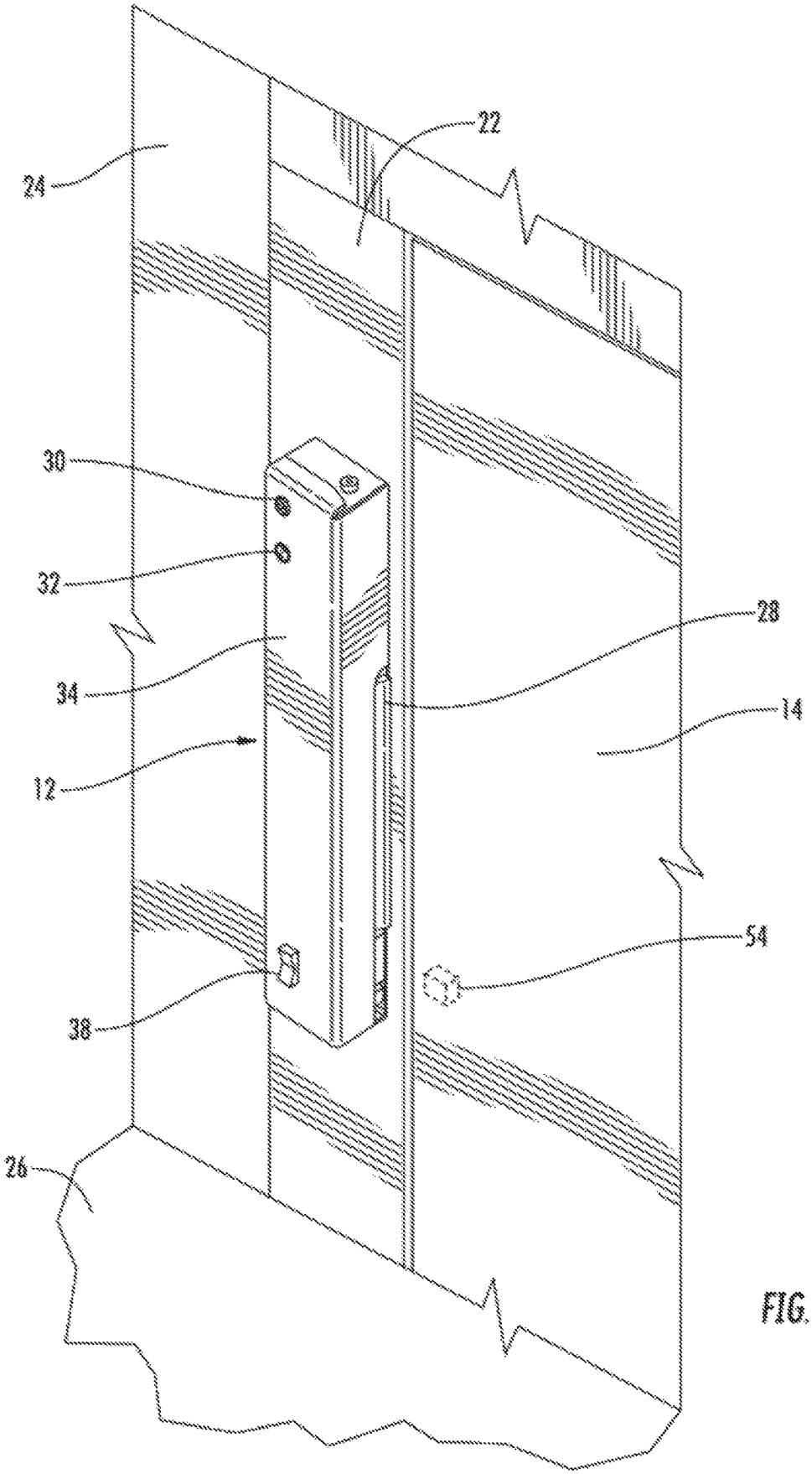
FIG. 1 is a perspective view of a lock module for a security system according to an embodiment of the present invention with the lock module in an unlocked position.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

As used in the claims, the definite article "said" identifies required elements that define the scope of embodiments of the claimed invention, whereas the definite article "the" merely identifies environmental elements that provide context for embodiments of the claimed invention that are not intended to be a limitation of any claim.

Embodiments of the present invention include a security system 10 for a building that provides local and/or remote lockdown and/or monitoring capability for multiple doors in the building to control access inside the building. The security system 10 includes a lock module 12 associated with each door 14 controlled by the security system 10. Each lock module 12 has an unlocked position that allows the associated door 14 to open and a locked position that prevents the associated door 14 from opening. As will be described, a controller 16 for each lock module 12 may generate a door status signal 18 and/or receive a lock module command signal 20. The door status signal 18 communicates information about the door 14 associated with the lock module 12, and the lock module command signal 20 directs the controller 16 to reposition the lock module 12 to either the locked or unlocked position.

Figure 2:
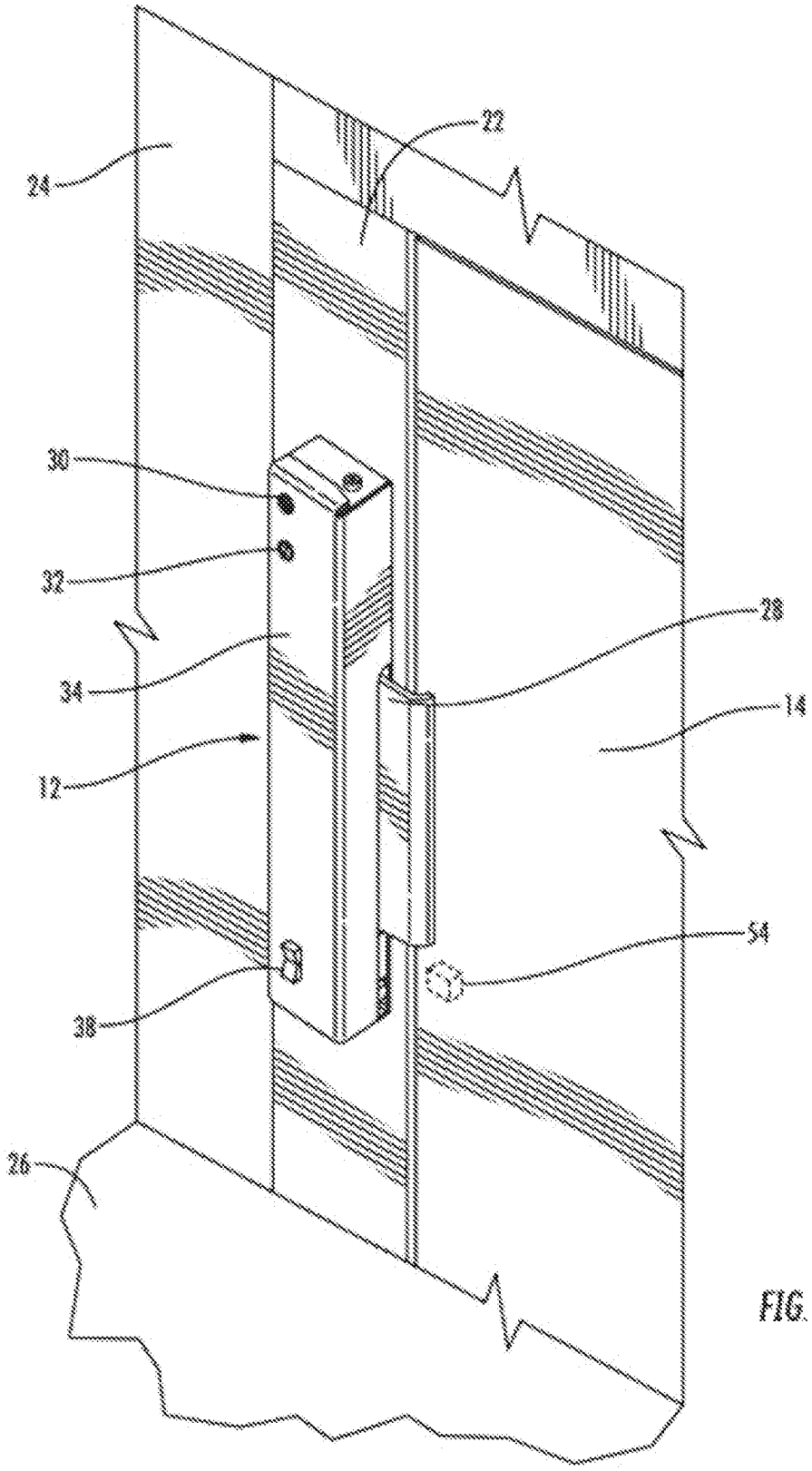
FIG. 2 is a perspective view of the lock module shown in FIG. 1 in a locked position.

FIGS. 1 and 2 provide a perspective view of the lock module 12 in the unlocked and locked positions, respectively, according to an embodiment of the present invention. As shown in FIGS. 1 and 2, each lock module 12 may be attached to a door frame 22, a wall 24, or a floor surface 26 adjacent to the associated door 14. A lock bar 28 associated with each lock module 12 has a first or retracted position (FIG. 1) and a second or extended position (FIG. 2). The first or retracted position (FIG. 1) allows the door 14 associated with the lock module 12 to open, and the second or extended position (FIG. 2) prevents the door 14 associated with the lock module 12 from opening. Although illustrated as a plate that extends or retracts from the lock module 12, one of ordinary skill in the art will appreciate that the lock bar 28 may be a rod, a bolt, or other similar structure that extends from the door frame 22, wall 24, and/or floor surface 26 to prevent the door 14 from opening, and the present invention is not limited to any particular structure unless specifically recited in the claims.

As shown in FIGS. 1 and 2, the lock module 12 may further include additional, optional features to monitor local conditions and enhance functionality of the security system 10. For example, the lock module 12 may include a speaker 30 and/or an image sensor 32 visible through a cover 34 of the lock module 12. The speaker 30 may generate an audible signal to alert occupants when the controller 16 receives the lock module command signal 20 to direct the associated lock module 12 to reposition to the unlocked and/or locked positions. The image sensor 32 may be a camera or video recorder that captures images or video of the surrounding area and generates an image or video signal 36. The image sensor 32 may continually capture images or video or may be enabled to only capture images or video and/or generate the image or video signal 36 when the controller 16 receives the lock module command signal 20 to direct the associated lock module 12 to reposition to the unlocked and/or locked positions.

The lock module 12 may optionally include a manual arm/disarm switch 38 that allows local control of the lock module 12 and generates an arm/disarm signal 40 when actuated. The manual arm/disarm switch 38 may be separate buttons or combined into a single rocker switch as shown in FIGS. 1 and 2. In this manner, an operator may depress the arm/disarm switch 38 to reposition the associated lock module 12 to the locked or unlocked position regardless of the lock module command signal 20.

Figure 3:
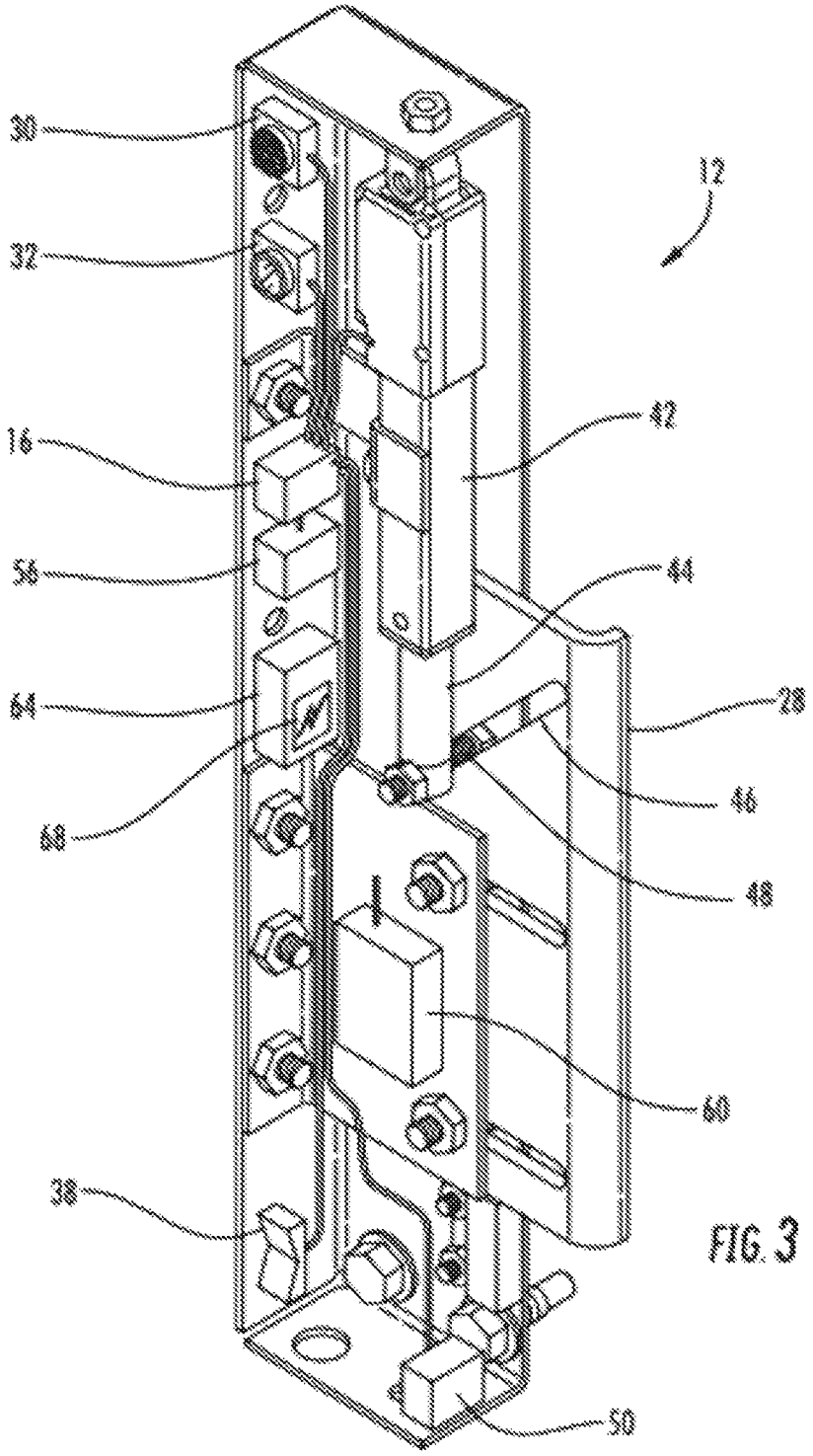
FIG. 3 is a perspective view of the lock module shown in FIG. 2 with the cover removed.

FIG. 3 provides a perspective view of the lock module 12 shown in FIG. 2 with the cover 34 removed. As shown in FIG. 3, an actuator 42 associated with the lock module 12 is operably connected to the lock bar 28 to move the lock bar 28 between the first or retracted position and the second or extended position. The actuator 42 may be any electrical, pneumatic, hydraulic, rotary, or geared device known in the art for moving the lock bar 28 between the first and second positions based on instructions 43 provided by the controller 16. As shown in FIG. 3, for example, the actuator 42 may include a reciprocating piston 44 connected by a follower 48 to a slot 46 in the lock bar 28. To move the lock bar 28 to the second or extended position, the controller 16 sends instructions 43 to the actuator 42 to extend the piston 44. As the piston 44 extends from the actuator 42, the follower 48 travels in the slot 46 to drive the lock bar 28 to the right, as shown in FIG. 3. To move the lock bar 28 to the first or retracted position, the controller 16 sends instructions 43 to the actuator to retract the piston 44. As the piston 44 retracts into the actuator 42, the follower 48 travels in the slot 46 to drive the lock bar 28 to the left.

Moving the lock module 12 to the locked position while the associated door 14 is open may actually lock the door 14 open or prevent the door 14 from being shut. Therefore, each lock module 12 may also include a sensor 50 that determines a position of the particular door 14 associated with the lock module 12 and generates a door position signal 52 that identifies if the particular door 14 is open or shut. The sensor 50 may be a proximity sensor that detects the presence or absence of the associated door 14 or a metallic object 54 in the door 14. The door position signal 52 may be used by the controller 16 as an interlock to prevent the actuator 42 from moving the lock bar 28 to the second or extended position when the door 14 is open.

An unauthorized visitor may attempt to physically breach the door 14 when the lock module 12 is in the locked position. As a result, each lock module 12 may also include a vibration sensor 56 that monitors the vibration level near the lock module 12 and generates a vibration signal 58 that reflects a level of vibration at the lock module 12.

Each lock module 12 may further include a modem 60, a status indicator 62, and a power distribution module 64. The modem 60 may transmit and receive information to and from the lock module 12 using cellular technology. For example, the modem 60 may receive the door status signal 18 from the controller 16 and transmit the door status signal 18 over a standard cellular network to other lock modules 12 in the security system 10. Alternately, or in addition, the modem 60 may receive the lock module command signal 20 from other lock modules 12 or the security system 10 and communicate the lock module command signal 20 to the controller 16 to reposition the lock module 12. The status indicator 62 may provide a local indication of the operability of the lock module 12. For example, the status indicator 62 may be a LED or visual display that indicates that the lock module 12 is receiving power, communicating with other lock modules 12, and available for operation. The power distribution module 64 may supply electricity from an external source 66 and/or internal battery 68 to the previously described components. In the event of loss of power from the external source 66, the power distribution module 64 may extend operation of each lock module 12 by selectively limiting power to components that are not directly associated with repositioning the lock module 12, such as the speaker 30, image sensor 32, and/or vibration sensor 56.

Figure 4:
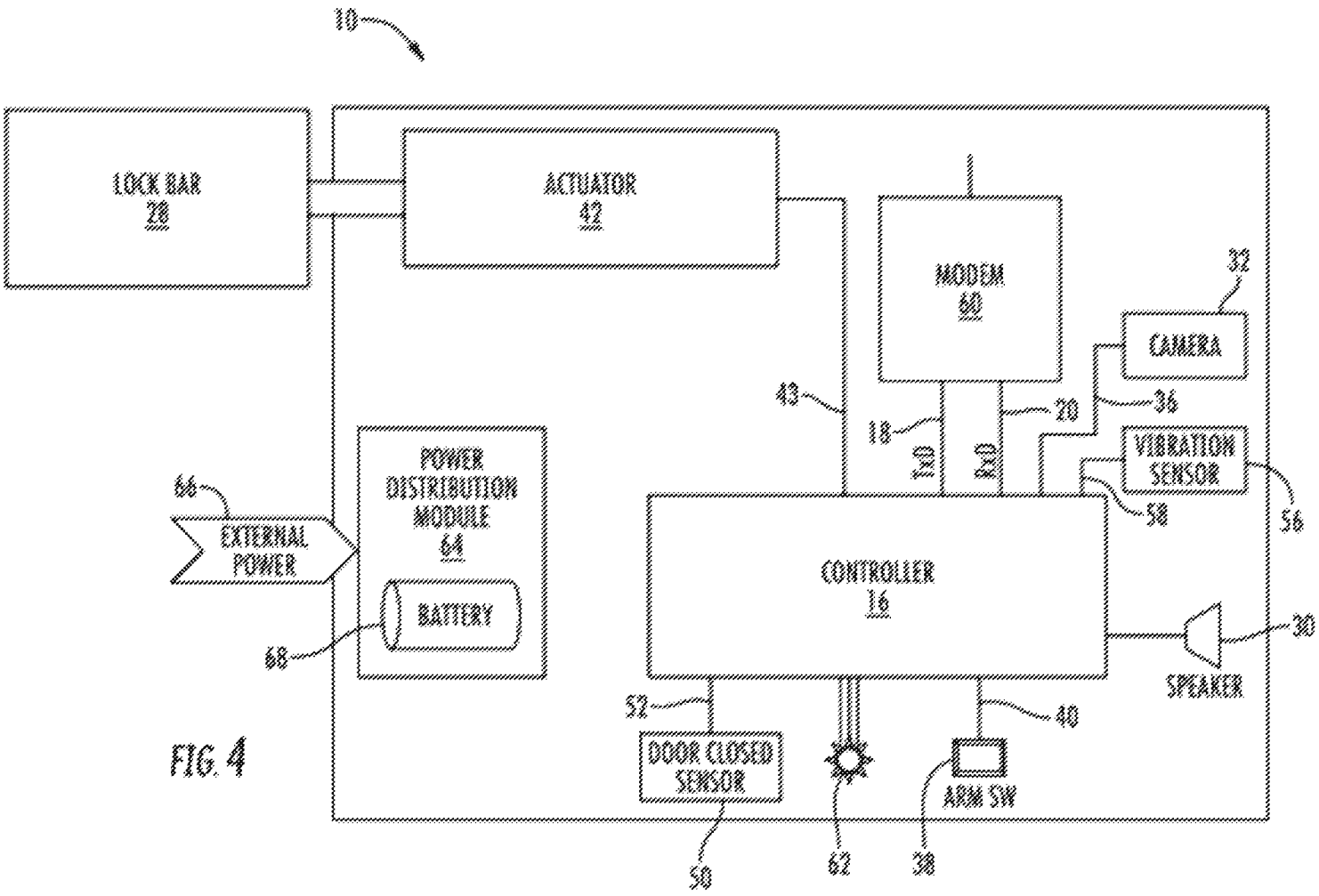
FIG. 4 is a functional block diagram of the security system according to an embodiment of the present invention.

FIG. 4 provides a functional block diagram of the security system 10 to illustrate the integration of the previously described components with the controller 16 according to an embodiment of the present invention. As used herein, the controller 16 is not limited to any particular hardware architecture or configuration. The controller 16 may be one or more general purpose or customized computing devices adapted in any suitable manner to provide the desired functionality. The device(s) may be adapted to provide additional functionality complementary or unrelated to the present subject matter, as well. For instance, one or more computing devices may be adapted to provide desired functionality by accessing logic or software instructions rendered in a computer-readable form. When software is used, any suitable programming, scripting, or another type of language or combinations of languages may be used to implement the teachings contained herein. However, software need not be used exclusively, or at all. For example, some embodiments of the systems and methods set forth herein may also be implemented by hard-wired logic or other circuitry, including, but not limited to application-specific circuits. Of course, combinations of computer-executed software and hard-wired logic or other circuitry may be suitable, as well.

As shown in FIG. 4, the controller 16 may transmit the door status signal 18 to the modem 60 for communication over a cellular network to other lock modules 12 or the security system 10. In particular embodiments, the door status signal 18 may include a unique identifier for the particular door 14 associated with the lock module 12 to allow the security system 10 to identify each door 14 included in the system. Alternately, or in addition, the door status signal 18 may include a heartbeat protocol that indicates an operational status for the lock module 12. For example, the heartbeat protocol may include periodic pings between the processor 16 and the various components associated with each lock module 12 to confirm operability, and the door status signal 18 may include the results of this check. If desired, the heartbeat protocol may provide a basis for the security system 10 to generate the lock module command signal 20 to one or more lock modules 12. For example, the security system 10 may be configured to generate the lock module command signal 20 to reposition the lock modules 12 to locked in the event the heartbeat protocol indicates that any single lock module 12 is inoperable.

As shown in FIG. 4, each previously described component may also communicate information to the controller 16 to enable the controller 16 to properly respond to the lock module command signal 20 and/or for inclusion in the door status signal 18. For example, the sensor 50 may communicate the door position signal 52 to the controller 16 to prevent the controller 16 from repositioning the lock module 12 to the locked position when the door 14 is not shut. Upon receipt of a lock module command signal 20 that directs the lock module 12 to reposition to the locked position, the controller 16 may send instructions 43 to the actuator 42 to reposition the lock bar 28 only if the door position signal 52 indicates that the associated door 14 is already shut. Otherwise, the controller 16 may delay repositioning the lock module 12 until the door position signal 52 indicates that the associated door 14 is shut. In any event, the controller 16 may include the door position signal 52 in the door status signal 18 so other lock modules 12 and the security system 10 have accurate information about the position of each door 14 in the system.

The manual arm/disarm switch 38 may similarly communicate the arm/disarm signal 40 to the controller 16 to cause the controller 16 to provide instructions 43 to the actuator 42 to reposition the lock module 12. For example, an operator may use the arm/disarm switch 38 to locally reposition the lock module 12 to the locked position. The controller 16 may also incorporate the arm/disarm signal 40 into the door status signal 18 for communication to other lock modules 12 or the security system 10. In this manner, the other lock modules 12 and/or security system 10 may propagate the arm/disarm signal 40 throughout the security system 10 using the lock module command signal 20 to similarly reposition all lock modules to the locked position.

As previously discussed, the image or video signal 36 may include images or video of the surrounding area, and the image sensor 32 may communicate this image or video signal 36 to the controller 16. Similarly, the vibration sensor 56 may communicate the vibration signal 58 to the controller 16. The controller 16 may, in turn, incorporate the image or video signal 36 and/or the vibration signal 58 into the door status signal 18 for transmission by the modem 60 to the security system 10. In this manner the security system 10 may receive the images, video, and/or vibration levels of the surrounding area for any lock modules 12 included in the system.

Attention is now directed more particularly to the various signals the security system 10 generates and uses and the associated communication and monitoring capabilities. As previously described, the door status signal 18 may communicate information about the lock module 12 and/or the door 14 associated with the lock module 12. For example, the door status signal 18 may include a unique identifier, serial number, or user-defined number that uniquely identifies each particular lock module 12. The door status signal 18 may further include the door position signal 52 for the particular door 14 associated with the lock module 12 to indicate the open or closed status of the associated door 14. The door status signal 18 may further identify when the associated lock module 12 has been manually positioned using the arm/disarm switch 38. The door status signal 18 may also include the vibration signal 58 that reflects a level of vibration at the associated lock module 12. For embodiments with the image sensor 32, the door status signal 18 associated with each lock module 12 may further include image data such as a still picture or a video of an area at the associated lock module 12. The door status signal 18 may also include what is referred to as a "heartbeat protocol" that indicates an operational status for the associated lock module 12 as described previously. The heartbeat protocol may be transmitted periodically at set intervals, random intervals, or upon command/request.

The lock module command signal 20 may direct the controller 16 to reposition the lock module 12 to either the locked or unlocked positions. Thus, the controller 16 may enable the associated lock module 12 to reposition to the locked position when directed by the lock module command signal 20 and the door position signal 52 reflects that the particular door 14 associated with lock module 12 is shut. If the controller 16 receives the lock module command signal 20 when the door position signal 52 reflects that the associated door 14 is open, the controller 16 may wait until the door position signal 52 reflects that the associated door 14 is shut before allowing the lock module 12 to reposition to the locked position. For embodiments having the manual arm/disarm switch 38, the locked/unlocked status of the lock module 12 may be changed at any time by actuating the arm/disarm switch 38.

The security system 10 may communicate the lock module command signal 20 to some or all of the controllers 16 to direct some lock modules 12 to reposition to the locked position and other lock modules 12 to reposition to the unlocked position. For example, upon receipt of a door status signal 18 indicating that a particular lock module 12 has been manually repositioned to the locked positions, the lock module command signal 20 may propagate the lock module command signal 20 to all other lock modules 12 to reposition all lock modules to the locked position. Alternately, the lock module command signal 20 may direct particular lock modules 12 to reposition to the unlocked position to provide an evacuation path or to direct a threat to a predetermined location. For example, the lock module command signal 20 may direct all lock modules 12 for classroom doors to reposition to the locked position while directing all lock modules for hallway doors to reposition to the unlocked position.

Figure 5:
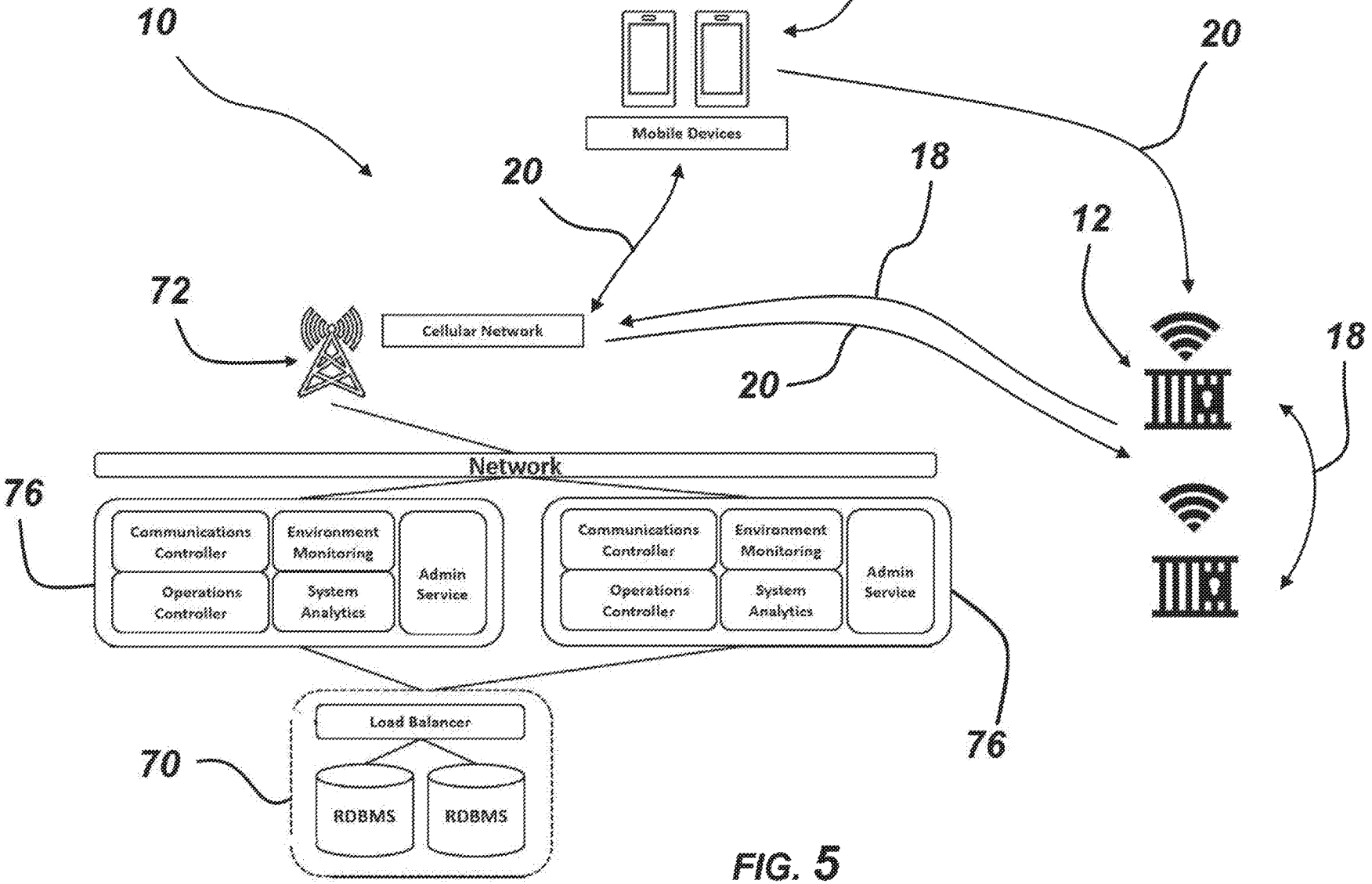
FIG. 5 is a high-level block diagram representation of one exemplary security system according to an embodiment of the present invention.

FIG. 5 provides a functional block diagram of the security system 10 communicating with a database server 70 through a cellular network 72 according to an embodiment of the present invention. Backend logic 76 installed on the database server 70 and/or registered personal communication devices 74 (e.g., a personal computer, smartphone, tablet, etc.) may allow a registered user to monitor and/or control the security system 10 locally and remotely. In this manner, the security system 10 may use the cellular network 72 to relay the door status signal 18 and the lock module command signal 20 between the lock modules 12 and the database server 70. For example, a registered user may use a registered personal communication device 74 to generate and transmit the lock module command signal 20 through the cellular network 72 to the database server 70. The database server 70 may then use the cellular network 72 to propagate the lock module command signal 20 to some or all of the lock modules 12 in the security system 10. Alternately, the registered user may generate and transmit the lock module command signal 20 to a particular lock module 12. The particular lock module 12 may then generate the door status signal 18 and use the cellular network 72 to effectively propagate the lock module command signal 20 to other lock modules 12 in the security system 10.

One of ordinary skill in the art will readily appreciate that the embodiments described and illustrated in FIGS. 1-5 may thus provide an improved security system for a building that allows doors 14 included in the system to be remotely or locally locked. In addition, the status of each lock module 12, the position of each door 14, and visual and physical conditions near each door 14 may be communicated throughout the security system 10 to enhance situational awareness and response time.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A security system for a building, comprising:

a plurality of lock modules, wherein each lock module is associated with a particular door and has an unlocked position that allows the particular door to open and a locked position that prevents the door from opening;

a door status signal associated with each lock module, wherein said door status signal comprises a unique identifier for the particular door associated with said lock module and a door position signal for the particular door associated with said lock module;

a controller associated with each lock module, wherein each controller transmits said door status signal for said associated lock module;

a lock module command signal communicated to at least some of said controllers, wherein said lock module command signal directs at least some of said lock modules to reposition to either said unlocked position or said locked position; and wherein each controller enables said associated lock module to reposition to said locked position when said door position signal reflects that the particular door associated with said associated lock module is shut.

2. The security system as in claim 1, wherein each lock module is attached to at least one of a door frame, a wall, or a floor surface adjacent to the particular door associated with each lock module.

3. The security system as in claim 1, wherein said door status signal associated with each lock module further comprises a status of said associated lock module that identifies when said associated lock module is in said locked position.

4. The security system as in claim 1, wherein said door status signal associated with each lock module further comprises a heartbeat protocol that indicates an operational status for said associated lock module.

5. The security system as in claim 1, wherein said door status signal associated with each lock module further comprises a vibration signal that reflects a level of vibration at said associated lock module.

6. The security system as in claim 1, wherein said door status signal associated with each lock module further comprises image data that reflects at least one of an image or a video of an area at said associated lock module.

7. The security system as in claim 1, wherein said lock module command signal reflects that a door status signal for at least one of said plurality of lock modules indicates said at least one lock module is in said locked position.

8. The security system as in claim 1, wherein said lock module command signal directs at least some of said lock modules to reposition to said unlocked position and others of said lock modules to reposition to said locked position.

9. The security system as in claim 8, wherein said lock module command signal provides a path for a threat to access a predetermined location.

10. The security system as in claim 1, further comprising a speaker associated with each lock module, and each speaker transmits an audible signal that reflects at least one of said unlocked or locked position of said associated lock module.

11. A security system for a building, comprising:

a plurality of lock modules, wherein each lock module is associated with a particular door and has an unlocked position that allows the particular door to open and a locked position that prevents the particular door from opening, and each lock module comprises:

a door status signal that comprises a unique identifier for the particular door associated with said lock module and a status that identifies when said lock module is in said locked position; and a controller that transmits said door status signal for said lock module;

a lock module command signal received by at least some of said plurality of lock modules, wherein said lock module command signal directs at least some of said lock modules to reposition to either said unlocked position or said locked position; and wherein each controller enables said associated lock module to reposition to said locked position when the particular door associated with said associated lock module is shut.

12. The security system as in claim 11, wherein each lock module is attached to at least one of a door frame, a wall, or a floor surface adjacent to the particular door associated with each lock module.

13. The security system as in claim 11, wherein said door status signal further comprises a heartbeat protocol that indicates an operational status for said lock module.

14. The security system as in claim 11, wherein said door status signal further comprises a vibration signal that reflects a level of vibration at said lock module.

15. The security system as in claim 11, wherein said door status signal further comprises image data that reflects at least one of an image or a video of an area at said lock module.

16. The security system as in claim 11, wherein said controller enables said lock module to reposition to said locked position when the particular door associated with said lock module is shut.

17. The security system as in claim 11, wherein said lock module command signal reflects that a door status signal for at least one of said plurality of lock modules indicates said at least one lock module is in said locked position.

18. The security system as in claim 11, wherein said lock module command signal directs at least some of said lock modules to reposition to said unlocked position and others of said lock modules to reposition to said locked position.

19. The security system as in claim 18, wherein said lock module command signal provides a path for a threat to access a predetermined location.

20. The security system as in claim 11, wherein each lock module further comprises a speaker, and each speaker transmits an audible signal that reflects at least one of said unlocked or locked position of said lock module.

* * * * *